United States Patent [19]

McRoskey et al.

[11] Patent Number: 4,778,250

[45] Date of Patent: Oct. 18, 1988

[54] LIGHTWEIGHT VERTICAL PANEL SAFETY-BARRICADE FOR STREETS AND HIGHWAYS

[75] Inventors: Peter K. McRoskey, Carlsbad; Paul M. Havlovitz, Escondido, both of Calif.

[73] Assignee: Republic Tool & Manufacturing Corp., Carlsbad, Calif.

[21] Appl. No.: 23,243

[22] Filed: Mar. 9, 1987

[51] Int. Cl.[4] ..... G02B 5/12; E01F 13/00; G09F 15/00

[52] U.S. Cl. ..... 350/97; 350/109; 404/6; 256/64; 40/606

[58] Field of Search ..... 350/97, 98, 102, 103, 350/109; 404/6, 71, 87, 7; 256/64; 40/612

[56] References Cited

U.S. PATENT DOCUMENTS

| | | | |
|---|---|---|---|
| 1,480,484 | 1/1924 | Wertz | 350/109 |
| 1,534,084 | 4/1925 | Schouboe | 40/612 |
| 1,562,835 | 11/1925 | Kuttler | 350/109 |
| 1,590,358 | 6/1926 | Finlay | 350/109 |
| 2,824,719 | 2/1958 | Nutting | 256/64 |
| 2,882,021 | 4/1959 | Dreher | 256/64 |
| 3,582,108 | 6/1971 | Carlton | 350/103 |
| 3,802,667 | 9/1974 | Kanan | 256/64 |
| 3,917,232 | 11/1975 | Linder | 256/64 |
| 3,950,873 | 4/1976 | Stehle et al. | 40/606 |

FOREIGN PATENT DOCUMENTS

| | | | |
|---|---|---|---|
| 1405780 | 9/1975 | United Kingdom | 404/6 |
| 2101180 | 1/1983 | United Kingdom | 404/6 |
| 2171440 | 8/1986 | United Kingdom | 404/6 |

*Primary Examiner*—John K. Corbin
*Assistant Examiner*—Loha Ben
*Attorney, Agent, or Firm*—Harry Williams

[57] ABSTRACT

A lightweight vertical panel barricade for use on streets and highways in which a first vertical panel is supported and rigidly locked into place by the clamping effect of respective ends of leg support members acting against a wall support of a housing structure disposed at each end of the panel member. The leg support members are rectangular in cross-section and are virtually gripped on three side faces thereof by the housing structures in which they are pivoted, both in their extended, panel support position and their closed, storage position. A second panel member depending from and coplanar with the first panel member is surrounded by the leg members and provides a doubling of the reflective surface of the barricade.

10 Claims, 3 Drawing Sheets

FIG 3
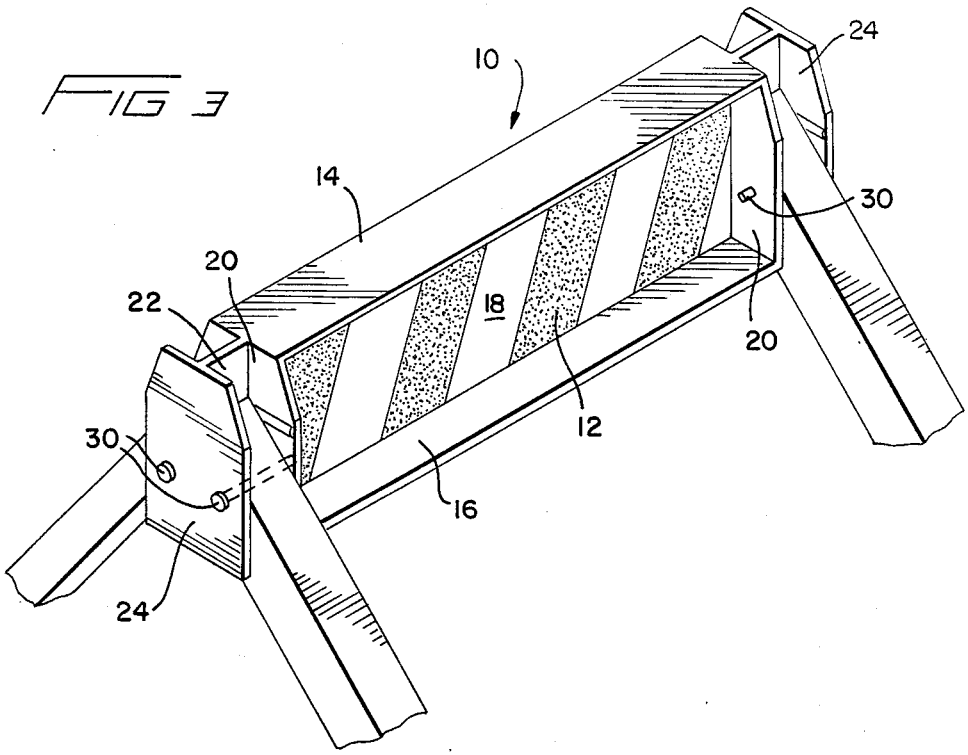
FIG 4
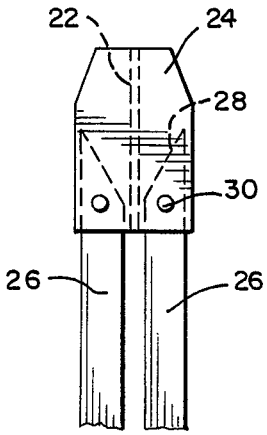
FIG 5
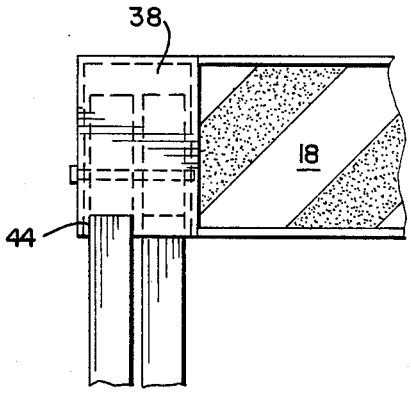
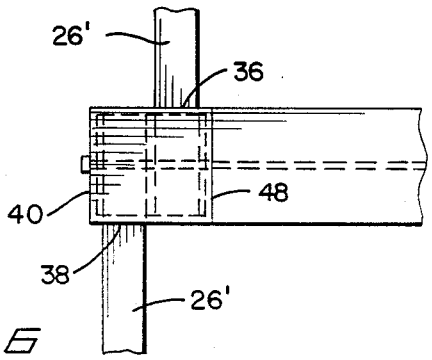
FIG 6

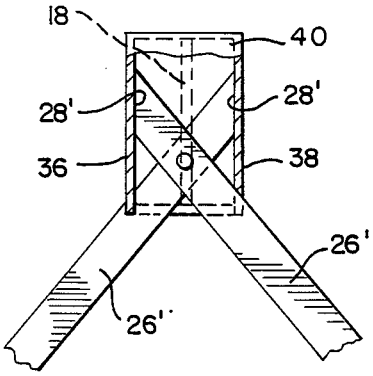
FIG 7
FIG 8
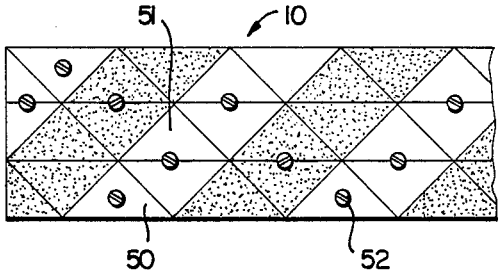
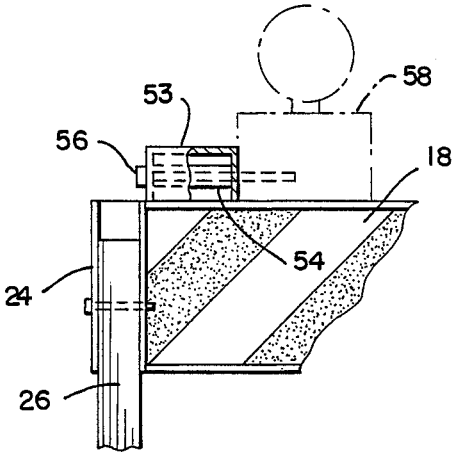
FIG 9
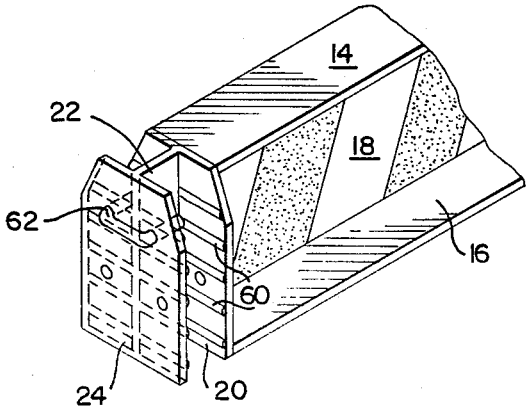
FIG 10

LIGHTWEIGHT VERTICAL PANEL SAFETY-BARRICADE FOR STREETS AND HIGHWAYS

BACKGROUND OF THE INVENTION

This invention related to barricade structures for streets and highways and more particularly to such barricades which comply with the requirements of the *Manual on Uniform Traffic Control Devices for Streets and Highways* issued by the U.S. Department of Transportation, Federal Highway Administration. Specifically, the DOT Manual describes two types of barricades with which the present invention is concerned; namely, Type I which is intended for use on conventional road or urban streets, and Type II which is for use on expressways, freeways or other high speed roadways. The difference between the two types is that the second type requires more reflective area. Type I can use a single reflective panel from 8 to 12 inches in height, for example, whereas Type II requires two such panels.

Past barricades have posed a number of problems in meeting such desirable objectives as portability, durability, reflective efficiency, as well as safety to a vehicle's occupants and persons in the work area whenever the barricade is struck by a fast moving vehicle. Any attempt to achieve all or nearly all of these objectives usually resulted in one or more of them being sacrificed by the promotion of the other. For example, in attempting to achieve durability the element of safety upon vehicular impact is often sacrificed. A wood or steel construction or a combination of these along with plastic, although durable, would prove extremely hazardous to the car, its occupants, and workmen in the area if hit by a vehicle, for example. On the other hand, a barricade that promoted safety and portability—a lightweight plastic construction, for example—might not be durable and might even fail to meet the requirements of DOT in not providing enough reflective area, that is, disposing the entire reflective area on a vertical plane which is normal to the traffic flow on a given street or highway. Such lightweight structures often resorted to the use of reflective panels disposed across the pivotal supporting legs so that reflective efficiency was impaired on two counts; (1) the reflective surface was angled away from the road surface as much as 30 degrees, thereby substantially reducing the brilliance of the retro-reflexive light from the reflecting surface, and (2) the effective width of an inclined 8 inch panel will not be the 8 inches required by DOT, that is, an 8 inch height normal or at right angles to traffic flow.

OBJECTS AND SUMMARY OF THE INVENTION

It is a primary purpose and principle object of the present invention to provide a safety-barricade structure which overcomes the aforementioned problems characteristically associated with barricade structures of the past. More particular, the present invention sets forth a durable, highly stable, collapsible, safety-barricade structure in compliance with the requirements of DOT, which structure is also lightweight, and portable, highly efficient as a retro-reflective device, economic to manufacture, and significantly reduces hazard to both automobile and personnel in the instance of an impact at high speed.

Specifically, the present invention provides a safety-barricade structure which is durable, lightweight and portable and which meets the requirement for both Type I and Type II barricades, according to the *Manual on Uniform Traffic Control Devices.* In accomplishing these objectives, the subject invention proposes a reinforced, all-plastic construction in which opposing end portions of pivotal leg members are disposed directly against opposing faces of a single support wall at each end of the vertical panels. In this way, the vertical panel, which bears a reflective substance on opposite faces thereof, becomes a substantial part of the supporting leg structure and defines a peripheral portion of that structure, and is therefore contained within the confines of the generally rectangular frame structure. Further, an additional vertically oriented panel may be depended from the first panel so as to be coplanar with the supported panel and also confined within the overall rectangular periphery of the structure.

In a further embodiment of the invention the pivotal leg structure presents opposing support faces against oppositely disposed support walls on the vertical panel.

The invention also provides a housing structure associated with the vertical panel in which the support wall or walls are located and which serves to contain associated portions of the leg members in a snug fit therewith both in the extended and the closed, storage positions of the leg members. The housing structure may also be provided with discrete bearing surfaces for enhancing free movement of the leg members in and out of the housing structure.

Further, the subject invention uses an arrangement of rigid reflective elements on the vertical panels; that is, 4 inch square and triangular half-squares of such reflective elements are secured on the entire face of the vertical panel to thereby effect an alternating arrangement of orange and white reflective strips.

The subject invention also proposes the use of a molded housing containing a boss structure therein on the top of the vertical plane for enabling a flashing light device to be bolted thereto.

The invention will be better understood as well as further objects and advantages thereof become more apparent from the ensuing detailed description taken in conjunction with the drawings.

BRIEF DESCRIPTION OF THE DRAWINGS

FIG. 3 is a schematic perspective view partially exploded of the safety barricade according to the invention;

FIG. 4 is a schematic end view, partially broken away of the pivotal leg structure of the safety-barricade according to the invention;

FIG. 5 is a schematic elevational view, partly broken away, of a second embodiment of the pivotal leg structure according to the invention;

FIG. 6 is a schematic plan view, partially broken away, of the leg structure shown in FIG. 5;

FIG. 7 is a schematic end view, partially broken away, of the leg-structure shown in FIG. 5;

FIG. 8 is a schematic elevational view of the reflective element arrangement on a vertical panel according to the invention;

FIG. 9 is a schematic elevational view, partially broken away, of the boss-housing for securing a flashing device to the safety barricade according to the invention; and FIG. 10 is a schematic perspective view of a further modification showing the discrete bearing surfaces for the structure shown in FIG. 3.

DETAILED DESCRIPTION

Figure 1:
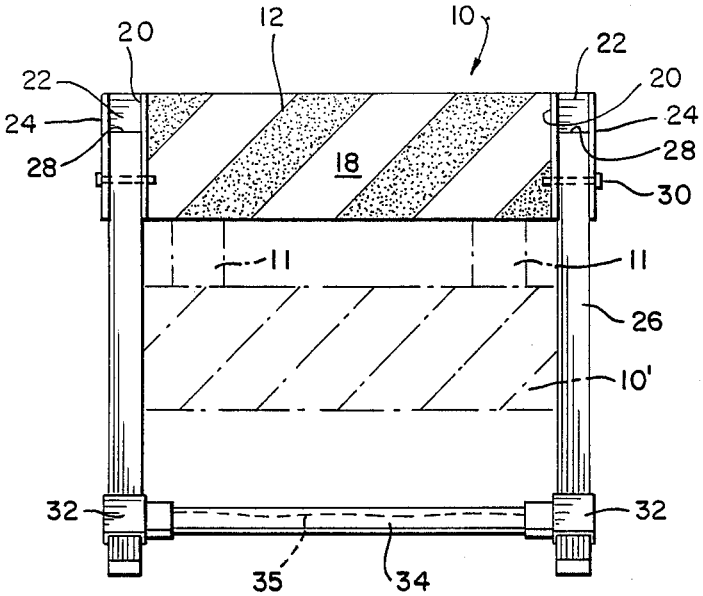
FIG. 1 is a schematic elevational view of the safety-barricade according to the invention.

Referring now to FIG. 1, the safety barricade according to the invention is composed of a vertical panel 10 bearing reflective markings 12 on opposite faces thereof, such as an 8 inch to 12 inch wide surface with 4 inch wide stripes at 45 degrees with respect to the long axis of the panel. It will be understood, therefore, that the barricade according to the invention will reflect in opposite directions by means of a single vertical panel. Additionally, as shown, a second depending panel 10', coplanar with the first panel may be affixed by suitable brackets 11 to the first or upper panel 10. By extending in a common vertical plane the panels 10 and 10' offer optimum reflection to passing vehicles. As shown more clearly in FIGS. 2 and 3, the panel 10 consists of a generally I-beam configuration, having top and bottom parallel walls 14 and 16 respectively, a median vertical wall 18, and opposing end walls 20. Since the wall construction at one end of the panel is a mirror image of the other, the same reference numbers will be used for identical parts. Extending coplanar with the median wall 18 from opposite faces of the end walls 20 is a leg suporting wall 22. Disposed at right angles at the end of the leg support walls 22 is an end plate 24 corresponding in size and shape to the end walls 20. All of the elements above-mentioned are suitably formed of molded plastic into a single unitary structure.

Figure 2:
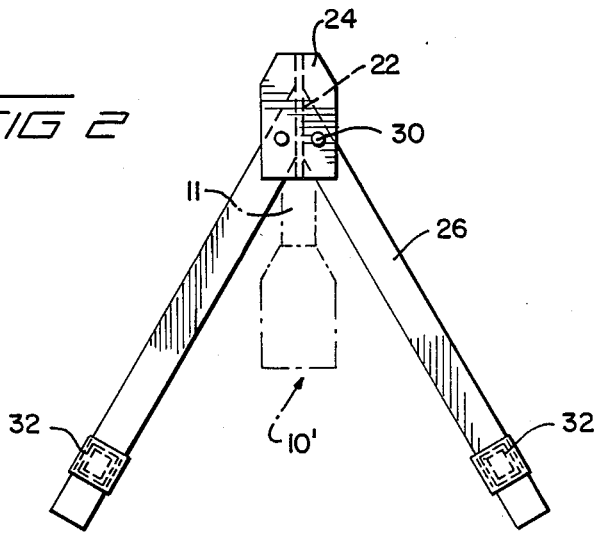
FIG. 2 is a schematic end view of the safety-barricade shown in FIG. 1.
Figure 2A:
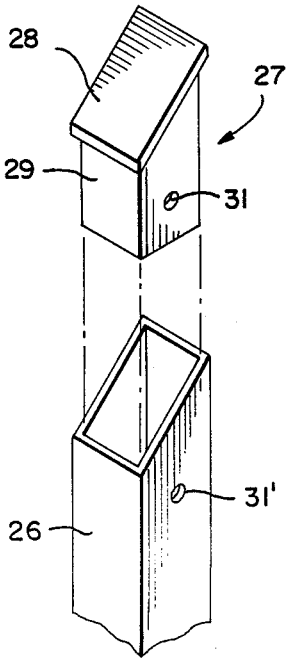
FIG. 2A is a schematic exploded perspective of one feature of the invention.

Between the end wall 20 and the corresponding end plate 24, there is thus provided a U-shaped channel on each side of the leg supporting wall 22 into which fits the upper portion of a leg member 26, as best shown on FIG. 3. The leg members are of a rectangular cross-section and are also formed of molded plastic. The rectangular cross-section of the leg members 26 allow for a snug fit of the upper portions thereof into the channel spaces adjacent the leg supporting walls 22. Further, the upper portion of the leg members 26 are angled to accept an oblique bearing insert 27 which rests flush against the leg supporting wall 22, as shown in FIG. 2. To pivotally secure the leg members 26 in their appropriate channel spaces, suitable bolts 30 extend through holes 31 provided in end plate 24, leg member 26, bearing insert 27, and end wall 20, as shown in FIG. 1. In FIG. 2A, the bearing insert 27 is shown to have a stem portion 29 for insertion into the interior end portion of leg member 26.

As shown in FIG. 2, the leg members 26 can be extended so that the angled bearing faces 28 are flush against opposing faces of the leg supporting wall 22. The vertical panel is thus firmly held and locked into place at each end thereof by means of the clamping effect of the opposed bearing faces 28 against the wall 22. Also, by virture of the rectangular shape of the legs 26, the side walls thereof at the upper portion are in contact with respective wall faces of end plate 24 and end wall 20. Thus the vertical panel 10 is secured rigidly on orthogonally related axes for optimum stability when the legs 26 are in their extended position.

To provide lateral support to the leg members 26, T-shape fittings 32, corresponding in cross-section to that of the leg members, are provided on the lower portions thereof, as shown in FIGS. 1 and 2. The stem portions of these fittings receive respective end portions of a tubular brace member 34, similar in cross-section to the leg members 26. Alternately, L-shaped fittings could be provided at the lower end portions of leg members 26 to thereby extend the brace 34 from lower end to lower end of the leg member.

Also shown in FIG. 1 is a suitable weighting agent 35, such as sand or lead shot, disposed within the interior of the cross-member brace 34. This weighting agent can be admitted via one of the hollow ends of the brace itself before it is affixed to the T-fittings, or a suitably removable plug and aperture therefor can be provided on the casing or shell of the brace for achieving this purpose.

An alternative embodiment of the pivotal support for the leg members 26 is shown in FIGS. 5–7. Here a closed housing structure replaces the open channel structure heretofore described. This box-like, closed housing serves to replace the leg support wall 22 in FIGS. 1–4 with two spaced and opposing leg support walls 36 and 38 respectively. In this embodiment leg support members 26' can be smaller dimensioned (but of rectangular cross-section for effecting maximum stability) so that both leg members can fit adjacent to each other between end wall 48 and end plate member 40 (see FIG. 5 and FIG. 6). Each of the leg support walls 36, 38 may be provided with suitable cut-out portions 44 to allow the leg members 26' to extend fully so that the angled bearing face 28' thereof (similar to the structure shown in FIG. 2A) rests flush against its respective support wall, as shown in FIG. 7.

FIG. 8 shows a particular arrangement of reflective elements, preferably rigid reflex-reflective elements, incorporating a corner-cube design as taught in U.S. Pat. No. 835,648 (Nov. 13, 1906) and more recently in U.S. Pat. No. 3,684,348 (Aug. 15, 1972). According to the present invention, each element is either a 4 inch square 51 of a triangular half-square 50. The elements 50, 51 are molded in different colors to produce contrasting stripes without the need for painting. By suitably riveting half or full squares to the panel by means of rivets 52, the entire panel is covered, as shown. Thus a panel measuring 8½ inches high and 25½ inches long will accommodate an exact number of squares and half squares to cover exactly one side of the entire panel. Naturally, this arrangement is repeated for the other, opposing side of the panel. For larger panels allowed by DOT it has been found that a panel measuring 11½ inches high and 25½ inches long will also yield an exact reflective covering of the panel.

In FIG. 9, there is shown a housing 53 fixed a top the vertical panel member 18. Interiorly of the housing and extending lengthwise thereof is a journaled boss member 54 for receiving a bolt 56 which extends therethrough and into a flashing device 58, having a suitably threaded bushing for that purpose.

In FIG. 10 a further modification of the invention is described wherein the opposing faces of the end wall 20 and the end plate 24 are provided with parallel bearing rib elements 60 which bear against the respective side walls of the upper portion of leg member 26. This construction allows for interstitial spaces to be formed between the sides of the leg member 26 and the respective wall faces 20, 24 of the U-shaped channel, thus preventing binding between the parts, as well as allowing for dirt and debris to escape from the interstitial spaces so provided.

Also shown in FIG. 10 is a further modification of the bolt assembly, namely, the provision of a U-bolt clamp 62, the respective legs of the U-bolt extending through the holes provided, as previously described. This manner of pivotally securing a pair of adjoining leg members 26 by a single U-bolt element in their respective channels prevents the otherwise separate bolts 30 from shearing apart under conditions of unusual stress.

The foregoing relates to a preferred embodiment of the invention, it being understood that other embodiments and variants thereof are possible within the spirit and scope of the invention, the letter being defined by the appended claims.

What is claimed and desired to be secured by Letter Patent of the United States is:

1. A barricade structure having a light reflective means for use in a highway or street, comprising a vertically oriented panel member bearing said light reflective means, said panel member having at opposed portions thereof a pair of oppositely disposed housing structures, each of said housing structures having wall support means, leg member means for supporting said panel member, means for pivotally supporting respective end portions of said leg member means in each of said housing structures, whereby a bearing face of each of said respective end portions of said leg member means bears against said wall support means for rigidly supporting said panel member in its vertical position when said leg member means is in a first, extended position, and said bearing face being free of contact with said wall support means, and said respective end portions of said leg member means being wholly contained within the periphery of each of said housing structures when said leg member means is in a second, closed storage position.

2. A barricade structure according to claim 1, wherein said housing structures and portions of said vertically oriented panel have substantially the same width and are coplanar.

3. A barricade structure according to claim 1, wherein said light reflective means comprises a striped array of injection molded reflective elements on opposite sides of said panel.

4. A barricade structure according to claim 1, wherein said light reflective means comprises a reflective sheeting on opposite sides of said panel.

5. A barricade structure according to claim 1, wherein said leg member means is generally hollow and rectangular in cross-section, and further comprising an auxiliary support leg means having a means for admitting a weighting agent to the interior thereof.

6. A barricade structure according to claim 1, wherein said panel member comprises a boss means thereon for enabling the attachment of a lighting fixture means to said panel member.

7. A barricade structure according to claim 1, wherein said housing structures each have discrete bearing surface portions disposed on selected side walls thereof for slidably bearing against a part of said respective end portions of said leg member means.

8. A barricade structure according to claim 1, wherein said pivotal support means comprises a U-bolt means, the respective legs of which each extend through each of said housing structures and said respective end portions of said leg member means.

9. A barricade structure having a light reflective means for use in a highway or street, comprising a vertically oriented panel member bearing said light reflective means, said panel member having at opposed portions thereof a pair of oppositely disposed housing structures, each of said housing structures having wall support means, leg member means for supporting said panel member, and means for pivotally supporting respective end portions of said leg member means in each of said housing structures, whereby a bearing face of each of said respective end portions of said leg member means bears against said wall support means for rigidly supporting said panel member in its vertical position when said leg member means is in an extended position.

10. A barricade structure having a light reflective means for use in a highway or street, comprising a vertically oriented panel member bearing said light reflective means, said panel member having at opposite ends thereof a pair of oppositely disposed housing structures, each of said housing structures having a median wall support and end walls normal thereto for defining a channel space on either side of said median wall support, leg member means for supporting said panel member, means for pivotally supporting respective end portions of said leg member means in said channel space, whereby a bearing face of each of said respective end portions of said leg member means bears against said wall support for rigidly supporting said panel member in its vertical position when said leg member means is in a first, extended position, and said bearing face being free of contact with said wall support, and said respective end portions of said leg member means being wholly contained within said channel space of each of said housing structures when said leg member means is in a second, closed storage position.

* * * * *